US007716852B2

(12) United States Patent
Berger et al.

(10) Patent No.: US 7,716,852 B2
(45) **Date of Patent: *May 18, 2010**

(54) CLIMATE CONFIGURABLE SOLE AND SHOE

(75) Inventors: Christoph Berger, Egloffstein (DE); Gerd Rainer Manz, Weisendorf (DE)

(73) Assignee: adidas International Marketing B.V., Amsterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 12/341,620

(22) Filed: Dec. 22, 2008

(65) Prior Publication Data

US 2009/0107013 A1 Apr. 30, 2009

Related U.S. Application Data

(63) Continuation of application No. 10/870,888, filed on Jun. 17, 2004, now Pat. No. 7,487,602, which is a continuation of application No. 09/915,216, filed on Jul. 25, 2001, now Pat. No. 6,817,112.

(30) Foreign Application Priority Data

Jul. 25, 2000 (DE) ..... 100 36 100

(51) Int. Cl.
*A43B 7/06* (2006.01)
*A43B 7/08* (2006.01)

(52) U.S. Cl. ..... 36/3 B; 36/103; 36/29; 36/147; 36/181

(58) Field of Classification Search ..... 36/3 A, 36/3 B, 3 R, 29, 141, 147, 25 R, 103, 98, 36/107, 28, 36 A, 34 A, 55, 145, 166, 181
See application file for complete search history.

(56) References Cited

U.S. PATENT DOCUMENTS 30,391 A 10/1860 Dexter (Continued)

FOREIGN PATENT DOCUMENTS

BE 1011574 11/1999

(Continued)

OTHER PUBLICATIONS

Asics, "Sport Schuhe & Taschen, Fruhjahr/Sommer 1999" brochure, and English translation, 4pgs.

(Continued)

*Primary Examiner*—Jila M Mohandesi
(74) *Attorney, Agent, or Firm*—Goodwin Procter LLP

(57) ABSTRACT

Disclosed are articles of footwear and soles therefor, in particular sports shoe soles that include openings for ventilation and vapor exchange. The soles include an insole layer with a plurality of first openings, a support layer with a plurality of second openings that partially overlap the plurality of first openings, and an outsole layer with at least one third opening that at least partially overlaps the plurality of second openings to provide fluidic communications through the sole from an interior of the shoe to an exterior of the shoe. A substantial portion of the plurality of first openings in the insole are interconnected to provide a path for diffusion. The shoes and soles can include a cushioning layer, a tread layer, a breathable membrane, and additional support elements. In addition, the shoes can be used with climate control socks to further enhance the climate control properties of the shoes.

14 Claims, 9 Drawing Sheets

U.S. PATENT DOCUMENTS

| | | | | |
|---|---|---|---|---|
| 41,879 | A | | 3/1864 | Webb |
| 60,987 | A | | 1/1867 | Ayer |
| 363,377 | A | | 5/1887 | Faye, Jr. |
| 387,335 | A | | 8/1888 | Barker |
| 556,825 | A | | 3/1896 | King |
| 570,814 | A | | 11/1896 | Owen |
| 592,822 | A | | 11/1897 | Parker |
| 896,488 | A | | 8/1908 | Valiant |
| 905,617 | A | | 12/1908 | Wood |
| 1,106,986 | A | | 8/1914 | Stilcki |
| 1,138,557 | A | | 5/1915 | Gustavenson |
| 1,535,207 | A | | 4/1925 | Dorff |
| 1,616,254 | A | | 2/1927 | Saurez |
| 1,797,309 | A | | 3/1931 | Wojciechowski |
| 1,828,320 | A | | 10/1931 | Daniels |
| 1,994,681 | A | | 3/1935 | Blumenfeld |
| 2,183,246 | A | | 12/1939 | Pikulik |
| 2,224,590 | A | | 12/1940 | Boivin |
| 2,307,416 | A | | 1/1943 | Margolin |
| 2,334,719 | A | | 11/1943 | Margolia |
| 2,347,207 | A | | 4/1944 | Margolia |
| 2,356,490 | A | | 8/1944 | Crotty |
| 2,358,342 | A | | 9/1944 | Margolin |
| 2,408,792 | A | | 10/1946 | Margolin |
| 2,432,533 | A | | 12/1947 | Margolia |
| 2,434,024 | A | | 1/1948 | Vlasak |
| 2,457,944 | A | | 1/1949 | Vlastos |
| 2,474,815 | A | | 7/1949 | Brahm |
| 2,525,939 | A | | 10/1950 | Howard |
| 2,547,480 | A | | 4/1951 | McDaniel |
| 2,614,339 | A | | 10/1952 | Herceg |
| 2,722,063 | A | | 11/1955 | Drefvelia |
| 2,725,645 | A | | 12/1955 | Scala |
| 2,751,692 | A | | 6/1956 | Cortina |
| 2,884,716 | A | | 5/1959 | Shelare et al. |
| 3,048,931 | A | | 8/1962 | Farinello |
| 3,061,950 | A | | 11/1962 | Levine |
| 3,086,301 | A | | 4/1963 | Pastor |
| 3,273,264 | A | | 9/1966 | Farinello, Jr. |
| 3,273,265 | A | | 9/1966 | Reinert et al. |
| 3,383,782 | A | | 5/1968 | McGinnity |
| 3,426,455 | A | | 2/1969 | Drago |
| 3,555,709 | A | | 1/1971 | Raffaelli, Sr. |
| 3,574,958 | A | | 4/1971 | Martuch |
| 3,834,046 | A | | 9/1974 | Fowler |
| 3,863,272 | A | | 2/1975 | Guille et al. |
| 3,982,336 | A | | 9/1976 | Herro |
| 4,000,566 | A | | 1/1977 | Famolare, Jr. et al. |
| 4,005,531 | A | | 2/1977 | Weintraub et al. |
| 4,100,685 | A | | 7/1978 | Dassler et al. |
| 4,130,947 | A | | 12/1978 | Denu et al. |
| 4,134,955 | A | | 1/1979 | Hanrahan, Jr. et al. |
| 4,151,660 | A | | 5/1979 | Yoshimi et al. |
| 4,197,618 | A | | 4/1980 | Bourguignon et al. |
| 4,222,183 | A | | 9/1980 | Haddox |
| 4,236,326 | A | | 12/1980 | Inohara et al. |
| 4,245,406 | A | | 1/1981 | Landay et al. |
| 4,257,176 | A | | 3/1981 | Hartung et al. |
| 4,290,211 | A | | 9/1981 | Csengeri |
| 4,297,796 | A | | 11/1981 | Stirtz et al. |
| 4,391,048 | A | | 7/1983 | Lutz |
| 4,438,573 | A | | 3/1984 | McBarron |
| 4,451,994 | A | | 6/1984 | Fowler |
| 4,485,568 | A | | 12/1984 | Landi et al. |
| 4,506,461 | A | | 3/1985 | Inohara et al. |
| 4,507,879 | A | | 4/1985 | Dassler et al. |
| 4,507,880 | A | | 4/1985 | Ohashi et al. |
| 4,523,393 | A | | 6/1985 | Inohara et al. |
| 4,542,598 | A | | 9/1985 | Misevich et al. |
| 4,617,745 | A | | 10/1986 | Batra |
| 4,619,055 | A | | 10/1986 | Davidson |
| 4,635,385 | A | | 1/1987 | Ogden |
| 4,640,027 | A | | 2/1987 | Berlese et al. |
| 4,654,982 | A | | 4/1987 | Lee et al. |
| 4,679,335 | A | | 7/1987 | Berlese et al. |
| 4,693,021 | A | | 9/1987 | Mazzarolo et al. |
| 4,739,765 | A | | 4/1988 | Sydor et al. |
| 4,754,559 | A | | 7/1988 | Cohen |
| 4,776,110 | A | | 10/1988 | Shiang et al. |
| 4,782,602 | A | | 11/1988 | Lakic |
| 4,798,009 | A | | 1/1989 | Colonel et al. |
| 4,813,160 | A | | 3/1989 | Kuznetz |
| 4,831,749 | A | | 5/1989 | Tsai et al. |
| 4,835,883 | A | | 6/1989 | Tetrault et al. |
| 4,837,948 | A | | 6/1989 | Cho et al. |
| 4,864,738 | A | | 9/1989 | Horovitz |
| 4,893,418 | A | | 1/1990 | Ogden |
| 4,894,932 | A | | 1/1990 | Harada et al. |
| 4,896,440 | A | | 1/1990 | Salaverria |
| 4,899,465 | A | | 2/1990 | Bleimhofer et al. |
| 4,899,467 | A | | 2/1990 | Mackey |
| 4,910,887 | A | | 3/1990 | Turner et al. |
| 4,918,841 | A | | 4/1990 | Turner et al. |
| 4,934,070 | A | | 6/1990 | Mauger et al. |
| 4,939,851 | A | | 7/1990 | Miller |
| 4,993,173 | A | | 2/1991 | Gardiner |
| 5,035,068 | A | | 7/1991 | Biasi |
| 5,044,096 | A | | 9/1991 | Polegato et al. |
| 5,070,629 | A | | 12/1991 | Graham et al. |
| 5,086,572 | A | | 2/1992 | Lee et al. |
| 5,189,816 | A | | 3/1993 | Shibata et al. |
| 5,195,254 | A | | 3/1993 | Tyng et al. |
| 5,235,791 | A | | 8/1993 | Yaguchi et al. |
| 5,295,312 | A | | 3/1994 | Blumberg et al. |
| 5,295,313 | A | | 3/1994 | Lee et al. |
| 5,317,819 | A | | 6/1994 | Ellis, III |
| 5,319,866 | A | * | 6/1994 | Foley et al. ..... 36/91 |
| 5,339,544 | A | | 8/1994 | Caberlotto et al. |
| 5,341,581 | A | | 8/1994 | Huang et al. |
| 5,342,070 | A | | 8/1994 | Miller et al. |
| 5,357,689 | A | | 10/1994 | Awai |
| 5,367,788 | A | | 11/1994 | Chen et al. |
| 5,367,791 | A | | 11/1994 | Gross et al. |
| 5,375,345 | A | | 12/1994 | Djuric et al. |
| 5,390,430 | A | | 2/1995 | Fitchmun et al. |
| 5,400,526 | A | | 3/1995 | Sessa |
| 5,401,039 | A | | 3/1995 | Wolf |
| 5,461,800 | A | | 10/1995 | Luthi et al. |
| 5,465,508 | A | | 11/1995 | Bourdeau et al. |
| 5,469,639 | A | | 11/1995 | Sessa |
| 5,469,644 | A | | 11/1995 | Vidler et al. |
| 5,485,687 | A | | 1/1996 | Rohde |
| 5,493,792 | A | | 2/1996 | Bates et al. |
| 5,499,459 | A | | 3/1996 | Tomaro |
| 5,505,011 | A | | 4/1996 | Bleimhofer et al. |
| 5,551,172 | A | | 9/1996 | Yu |
| 5,584,130 | A | | 12/1996 | Perron et al. |
| 5,588,226 | A | | 12/1996 | Schenkel et al. |
| 5,598,644 | A | | 2/1997 | Polegato et al. |
| 5,607,745 | A | | 3/1997 | Ogden |
| 5,611,152 | A | | 3/1997 | Richard et al. |
| 5,619,809 | A | | 4/1997 | Sessa |
| 5,628,127 | A | | 5/1997 | Notzold et al. |
| 5,634,245 | A | | 6/1997 | Rouser et al. |
| 5,655,314 | A | | 8/1997 | Petracci et al. |
| 5,661,915 | A | | 9/1997 | Smith |
| 5,664,343 | A | | 9/1997 | Byrne |
| 5,675,914 | A | * | 10/1997 | Cintron ..... 36/3 B |
| 5,685,091 | A | | 11/1997 | Yalamanchili |
| 5,689,901 | A | | 11/1997 | Bell et al. |
| 5,697,171 | A | | 12/1997 | Phillips |
| 5,699,627 | A | | 12/1997 | Castro et al. |
| 5,709,042 | A | | 1/1998 | Houdroge |
| 5,714,229 | A | | 2/1998 | Ogden |

| | | | | |
|---|---|---|---|---|
| 5,732,480 | A | 3/1998 | Notzold et al. | |
| 5,737,856 | A | 4/1998 | Brockman | |
| 5,738,937 | A | 4/1998 | Baychar | |
| 5,797,610 | A | 8/1998 | Grande et al. | |
| 5,809,665 | A | 9/1998 | Suenaga et al. | |
| 5,815,949 | A | 10/1998 | Sessa | |
| 5,826,349 | A | 10/1998 | Goss | |
| 5,845,418 | A | 12/1998 | Chi et al. | |
| 5,852,884 | A | 12/1998 | Miotto et al. | |
| 5,918,381 | A | 7/1999 | Landry | |
| 5,946,824 | A | 9/1999 | Tighe et al. | |
| 5,955,172 | A | 9/1999 | Hurten et al. | |
| 5,979,076 | A | 11/1999 | Li et al. | |
| 5,983,524 | A | 11/1999 | Polegato et al. | |
| 5,983,525 | A | 11/1999 | Brown | |
| 5,992,052 | A | 11/1999 | Moretti et al. | |
| 5,996,250 | A | 12/1999 | Reed et al. | |
| 6,006,447 | A | 12/1999 | Neal et al. | |
| 6,012,236 | A | 1/2000 | Pozzobon et al. | |
| 6,032,388 | A | 3/2000 | Fram | |
| 6,041,518 | A * | 3/2000 | Polycarpe | 36/2.6 |
| 6,041,519 | A | 3/2000 | Cheng et al. | |
| 6,044,577 | A | 4/2000 | Clark | |
| 6,085,444 | A | 7/2000 | Cho et al. | |
| 6,196,556 | B1 | 3/2001 | Bonaventure et al. | |
| 6,239,501 | B1 | 5/2001 | Komarechka et al. | |
| 6,255,799 | B1 | 7/2001 | Le et al. | |
| 6,256,824 | B1 * | 7/2001 | Austin et al. | 12/142 P |
| 6,389,711 | B1 * | 5/2002 | Polegato | 36/3 R |
| 6,401,364 | B1 | 6/2002 | Burt | |
| 6,408,541 | B1 | 6/2002 | Moretti et al. | |
| 6,416,610 | B1 | 7/2002 | Matis et al. | |
| 6,421,933 | B1 | 7/2002 | Zamprogno et al. | |
| 6,442,760 | B2 | 9/2002 | Moretti et al. | |
| 6,446,359 | B2 | 9/2002 | Tomat et al. | |
| 6,446,360 | B1 | 9/2002 | Sheets et al. | |
| 6,487,891 | B2 | 12/2002 | Moretti et al. | |
| 6,508,015 | B1 | 1/2003 | Rauch et al. | |
| 6,562,271 | B2 | 5/2003 | Hiraoka et al. | |
| 6,594,917 | B2 | 7/2003 | Ricco' et al. | |
| 6,594,918 | B2 | 7/2003 | Hatfield et al. | |
| 6,604,302 | B2 | 8/2003 | Polegato Moretti et al. | |
| 6,655,048 | B2 * | 12/2003 | Moretti | 36/3 R |
| 6,662,469 | B2 | 12/2003 | Belley et al. | |
| 6,681,500 | B2 * | 1/2004 | Moretti | 36/3 B |
| 6,701,639 | B2 | 3/2004 | Treptow et al. | |
| 6,725,571 | B2 | 4/2004 | Liu et al. | |
| 6,742,288 | B2 | 6/2004 | Choi et al. | |
| 6,751,890 | B1 | 6/2004 | Tsai et al. | |
| 6,817,112 | B2 | 11/2004 | Berger et al. | |
| 6,823,609 | B2 | 11/2004 | Moretti et al. | |
| 6,865,825 | B2 | 3/2005 | Bailey, Sr. et al. | |
| 6,874,251 | B2 | 4/2005 | Moretti et al. | |
| 6,904,705 | B2 | 6/2005 | Polegato Moretti et al. | |
| 6,918,695 | B2 | 7/2005 | Polegato Moretti et al. | |
| 2001/0011426 | A1 | 8/2001 | Tomat | |
| 2002/0011009 | A1 | 1/2002 | Pan | |
| 2002/0012784 | A1 | 1/2002 | Norton et al. | |
| 2002/0017036 | A1 | 2/2002 | Berger et al. | |
| 2002/0040537 | A1 | 4/2002 | Polegato Moretti | |
| 2002/0050074 | A1 | 5/2002 | Ricco et al. | |
| 2002/0078593 | A1 | 6/2002 | Pavelescu et al. | |
| 2002/0100187 | A1 | 8/2002 | Polegato | |
| 2002/0166262 | A1 | 11/2002 | Hernandez | |
| 2002/0184927 | A1 | 12/2002 | Polegato Moretti | |
| 2003/0136024 | A1 | 7/2003 | Su | |
| 2004/0013883 | A1 | 1/2004 | Polegato Moretti | |
| 2004/0035022 | A1 | 2/2004 | Polegato Moretti | |
| 2004/0045189 | A1 | 3/2004 | Polegato Moretti | |
| 2005/0000117 | A1 | 1/2005 | Polegato Moretti | |
| 2005/0016032 | A1 | 1/2005 | Cox et al. | |
| 2005/0060906 | A1 | 3/2005 | Zimerfeld | |
| 2005/0102856 | A1 | 5/2005 | Jones et al. | |
| 2005/0241082 | A1 | 11/2005 | Moretti | |
| 2005/0252035 | A1 | 11/2005 | Moretti et al. | |

FOREIGN PATENT DOCUMENTS

| | | |
|---|---|---|
| CA | 2047044 | 3/1997 |
| CH | 198691 | 7/1938 |
| CH | 418 179 | 7/1966 |
| DE | 20808 | 4/1882 |
| DE | 121957 | 10/1900 |
| DE | 203734 | 4/1908 |
| DE | 600 894 | 8/1934 |
| DE | 800 364 | 11/1950 |
| DE | 32 25 451 | 2/1983 |
| DE | 92 08 875.9 | 10/1992 |
| DE | 41 28 704 | 3/1993 |
| DE | 199 37 334 | 10/2001 |
| EP | 0 121 645 | 10/1984 |
| EP | 0 353 430 | 6/1989 |
| EP | 0 427 556 | 5/1991 |
| EP | 0 458 174 | 5/1991 |
| EP | 0 471 447 | 2/1992 |
| EP | 0 479 183 | 4/1992 |
| EP | 0 350 611 | 5/1995 |
| EP | 0 732 067 | 9/1996 |
| EP | 0 857 433 | 8/1998 |
| EP | 0 910 964 | 4/1999 |
| EP | 0 927 524 | 7/1999 |
| EP | 0 956 789 | 11/1999 |
| EP | 0 960 579 | 12/1999 |
| EP | 1 118 280 | 7/2001 |
| EP | 1 312 275 | 5/2003 |
| FR | 1 142 786 | 9/1957 |
| GB | 395 221 | 7/1933 |
| GB | 2 183 140 | 6/1987 |
| GB | 2 27 391 | 3/1992 |
| GB | 2 315 010 | 1/1998 |
| IT | 352 511 | 9/1937 |
| JP | S09-17148 | 1/1935 |
| JP | S54-30540 | 8/1977 |
| JP | S57-68605 | 10/1980 |
| JP | S58-65101 | 4/1983 |
| JP | H02-57403 | 4/1990 |
| JP | H02-11802 | 2/1991 |
| JP | 03-236801 | 10/1991 |
| JP | H4-24962 | 6/1992 |
| JP | 06-141906 | 5/1994 |
| JP | 07-008301 | 1/1995 |
| JP | 07-047003 | 2/1995 |
| JP | 07-327706 | 12/1995 |
| JP | 08-056704 | 3/1996 |
| JP | 08-112104 | 5/1996 |
| JP | 09-019305 | 1/1997 |
| JP | 09-285310 | 11/1997 |
| JP | 10-014605 | 1/1998 |
| JP | 11-042103 | 2/1999 |
| JP | 2000-050904 | 2/2000 |
| JP | 10-362414 | 6/2000 |
| JP | 2000-175701 | 6/2000 |
| JP | 2001-029110 | 6/2001 |
| JP | 2002-518118 | 6/2002 |
| WO | WO-94/06317 | 3/1994 |
| WO | WO-97/28711 | 8/1997 |
| WO | WO-98/51177 | 11/1998 |
| WO | WO-99/66812 | 12/1999 |
| WO | WO-2005/011417 | 2/2005 |
| WO | WO-2005/063069 | 7/2005 |
| WO | WO-2005/063070 | 7/2005 |
| WO | WO-2005/070658 | 8/2005 |

OTHER PUBLICATIONS

Asics, "Sportschuhe & Taschen, Herbst/Winter 1999" brochure, and English translation, 6 pgs.

New Balance, "Fall 1998, Performance Footwear" brochure, 2 pgs.

Lotto, "Schuhe/Textilien Saison '98/'99" brochure, and English transition, 6 pgs.

Reebok, "Schuhe 3. Quartel 1998" brochure, and English translation, 6 pgs.

* cited by examiner

CLIMATE CONFIGURABLE SOLE AND SHOE

CROSS-REFERENCE TO RELATED APPLICATION

This application incorporates by reference, and claims priority to and the benefit of, German patent application serial number 10036100.5, which was filed on Jul. 25, 2000.

TECHNICAL FIELD

The invention generally relates to articles of footwear and soles therefor. In particular, the invention relates to a sole for athletic or sports footwear that includes openings for ventilation and vapor exchange.

BACKGROUND INFORMATION

The technical development of shoes, in particular sport shoes, has advanced in recent years. Presently, shoe constructions can be adapted to accommodate the mechanical stresses arising on a wearer's foot during different kinds of sporting activities and provide a high degree of functionality and wearing comfort. In spite of these developments, it was not possible to manufacture shoes that, in addition to providing damping and support for the foot, also provide a comfortable climate for the foot. For example, the use of foamed plastic materials, which is common in modern sports shoes, prevents heat and humidity from being sufficiently transported away from the foot to efficiently avoid a hot feeling, an unpleasant odor, or a risk of diseases of the foot. These disadvantages present a severe problem in the case of sports shoes. Because of the increased physical activity during sporting activities, more heat and humidity arise in the foot area within the shoe. For this reason, there are different approaches to provide ventilation and removal of sweat from the foot area within the shoe.

For example, Swiss Patent No. 198 691 discloses an insole, wherein a leather sole provided with holes is arranged as a top layer on a frame-like supporting layer. The foot is to be surrounded by air from all sides to account purportedly for the breathing requirements of the foot sole. A similar construction is disclosed in United Kingdom Patent No. GB 2 315 010. Both Swiss Patent No. 198 691 and United Kingdom Patent No. GB 2 315 010 are hereby incorporated herein by reference. A disadvantage, however, is that no exchange takes place between the volume of air arranged below the foot sole and the surrounding air. As a result, humidity and bacteria can accumulate in the shoe.

Another approach is to connect an air volume, usually provided below the insole, with the outside air via lateral openings. The repeated compression of the shoe sole, a result of the action of the foot while running or walking, purportedly causes the warm air and humidity from the air volume inside the shoe to be pumped to the outside air with each step, thereby transporting humidity away. Examples of such shoes are disclosed in German Patent No. DE 121 957 and U.S. Pat. Nos. 5,035,068, 4,837,948, and 5,655,314, all of which are hereby incorporated herein by reference.

There are, however, problems with the foregoing concepts. First, the pumping action provided by the compression of the sole is too weak to assure a substantial exchange of air via the lateral openings, which may be several centimeters away. As such, the warm air and the humidity are only slightly moved back and forth without actually leaving the air volume from within the shoe. Second, a recess arranged below the insole, which contains the air volume, is so big that a soft shoe is created, which is mechanically unstable.

According to another concept, arrangements of partly closeable openings on a shoe upper can be used, examples of which can be found in U.S. Pat. Nos. 4,693,021, 5,357,689, and 5,551,172, all of which are hereby incorporated herein by reference. These arrangements do not have any influence on the aforementioned disadvantages, because the heat and humidity dispensed by the foot is predominantly arising in the foot sole area. As such, openings on the shoe upper do not significantly contribute to the ventilation of the foot sole area. Therefore, the arrangement of ventilation openings on the shoe upper does not result in a shoe that provides a comfortable and healthy foot climate.

Yet another approach is disclosed in U.S. Pat. No. 4,290,211, which is hereby incorporated herein by reference. Here, an outsole is perforated by a plurality of conically tapered openings and an insole has perforations that exactly coincide with the openings of the outsole. Although sufficient ventilation may be possible by this direct vertical connection from the foot sole to the outside, multiple through-holes reduce the mechanical stability of the sole, so only a few openings can be provided. This, however, reduces the desired ventilation effect. As a result, such a simple perforation of the shoe sole has not become popular, in particular in the case of sports shoes.

With the introduction of so-called "climate membranes," one example of which is the GORE-TEX® brand sold by W.L. Gore & Associates, the holes in the outsole are covered by a breathable membrane. Such constructions can be found in International Patent Application Publication No. WO97/28711 and European Patent Application No. EP 0 956 789, which are hereby incorporated herein by reference. Although the use of climate membranes may lead to improved watertightness of the shoe, the above described disadvantages concerning the stability of the shoe are not overcome, but worsened, because even with a breathable membrane, more through-holes in the sole are necessary to assure sufficient ventilation of the foot sole.

Furthermore, International Patent Application Publication No. WO99/66812, European Patent Application No. EP 0 960 579, and U.S. Pat. Nos. 5,983,524 and 5,938,525, the disclosures of which are hereby incorporated herein by reference, disclose combinations of the above-described approaches, but without overcoming the respective disadvantages. In one example, the five-layer system disclosed in U.S. Pat. No. 5,983,525 consists of an outsole, a membrane, a protecting layer, a filling layer, and an insole with isolated arranged perforations in their respective layers. This system is far too dense for effective ventilation of the sole area, even if breathing active materials are used.

SUMMARY OF THE INVENTION

The climate control shoe sole of the present invention overcomes the disadvantages of known sports shoes and methods for transporting heat and humidity from a wearer's foot. Generally, the sole, as described herein, assures a comfortable and healthy foot by providing proper ventilation and air exchange within the shoe, while at the same time preserving the mechanical stability required for sports shoes.

In one aspect, the invention relates to a sole for an article of footwear. The sole includes an insole layer with a plurality of first openings, a support layer with a plurality of second openings, and an outsole layer with at least one third opening. A substantial portion of the plurality of first openings in the insole layer are interconnected. The openings in each of the layers are arranged such that the second openings in the support layer partially overlap the first openings in the insole layer and the at least one third opening in the outsole layer partially overlaps the second openings in the support layer.

In another aspect, the invention relates to an article of footwear including an upper and a sole. The sole includes an insole layer with a plurality of first openings, a support layer with a plurality of second openings, and an outsole layer with at least one third opening. A substantial portion of the plurality of first openings in the insole layer are interconnected. The openings in each of the layers are arranged such that the second openings in the support layer partially overlap the first openings in the insole layer and the at least one third opening in the outsole layer partially overlaps the second openings in the support layer. In one embodiment, the upper is made of a reinforced mesh material. Optionally, the article of footwear can include a climate control sock that has a two layer mesh construction.

In various embodiments of the foregoing aspects of the invention, the plurality of first openings are distributed over substantially the entire insole layer and the first openings may be generally circularly shaped. In some embodiments, a first portion of the plurality of first openings are disposed in at least one of a ball region and a heel region of the sole and a second portion of the plurality of first openings are disposed in the remaining regions of the sole. The openings of the first portion may be smaller than the openings of the second portion. In one embodiment, the openings of the first portion are less than about 3 millimeters (mm) in diameter and the openings of the second portion are greater than about 4 mm in diameter. In other embodiments, at least one channel interconnects a portion of the first openings and the channel is disposed on a bottom side of the insole layer.

In some embodiments, the support layer is a substantially compression resistant semi-rigid chassis that controls deformation properties of the sole. The support layer may extend along a heel region and/or a ball region of the sole. In various embodiments, the plurality of second openings in the support layer may be disposed in a toe region and/or an arch region and/or an upwardly extending portion of the sole. In some embodiments, the plurality of second openings form a grill pattern. In other embodiments, the support layer may further include a support element disposed in the arch region of the sole. The support element interconnects a forefoot part and a rearfoot part of the sole, and the support layer and/or the support element may sideways encompass a wearer's foot in the arch region and/or the heel region of the sole.

In additional embodiments, the outsole layer of the invention may include a plurality of sole elements, for example a forefoot element and a rearfoot element. The outsole layer may extend along the heel region and/or the ball region of the sole. In various embodiments, the at least one third opening is disposed in the toe region and/or the arch region of sole and overlaps with corresponding second openings in the support layer. The outsole layer may also sideways encompass the wearer's foot in the heel region and/or a forefoot region of the sole. In other embodiments, the outsole layer further includes a cushioning layer and/or a tread layer.

In still other embodiments, the sole may include a membrane disposed between the support layer and the insole layer. In some embodiments, a shoe in accordance with the invention may include a flexible net-like element for selective reinforcement of parts of an upper. The flexible net-like element may be disposed in a heel region of the upper, for example, the medial and/or lateral side of a wearer's ankle.

These and other objects, along with advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

Embodiments of the present invention are described below. It is, however, expressly noted that the present invention is not limited to these embodiments, but rather the intention is that modifications that are apparent to the person skilled in the art are also included. In particular, the present invention is not intended to be limited to sports shoes, but rather it is to be understood that the present invention can also be used to improve the foot climate of any article of footwear. Further, only a left or right sole and/or shoe is depicted in any given figure; however, it is to be understood that the left and right soles/shoes are typically mirror images of each other and the description applies to both left and right soles/shoes.

Generally, a sole in accordance with the invention includes at least three layers that may include several function specific components. Each of the layers has one or more openings disposed therein, such that ventilation and air exchange may occur within the shoe, thus improving the climate properties of the shoe. The one or more openings in each layer partially overlap the openings in the adjacent layer when the shoe sole is fully assembled. By the arrangement of the three or more layers with openings that only partially overlap, a substantially greater number of openings can be provided in the insole layer without reducing the mechanical stability of the shoe. As a result, the heat and humidity generated can be removed directly from the foot sole much more quickly than with conventional shoe designs.

Figure 1A:
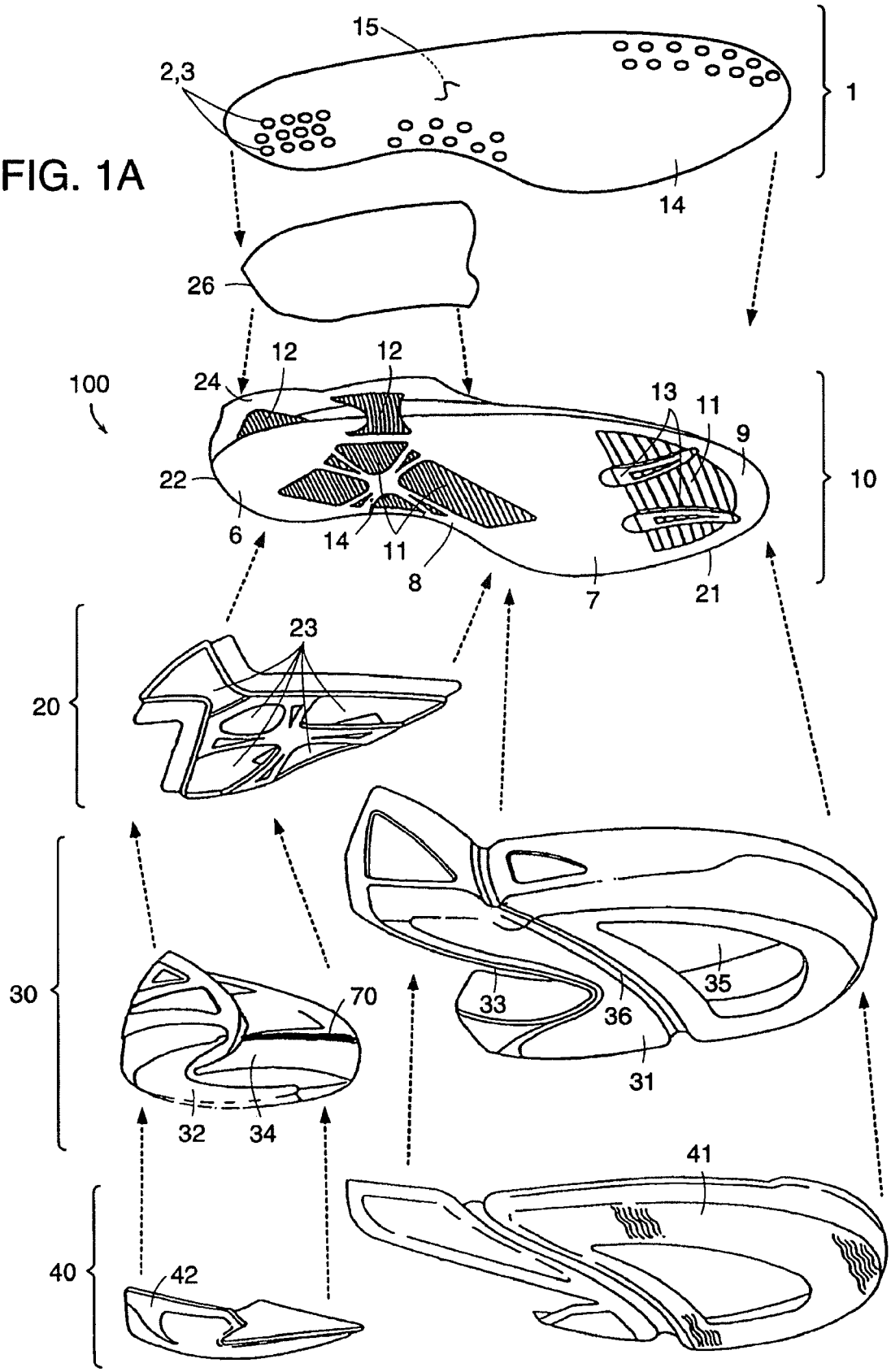
FIG. 1A is an exploded isometric view of one embodiment of a sole in accordance with the invention.
Figure 3:
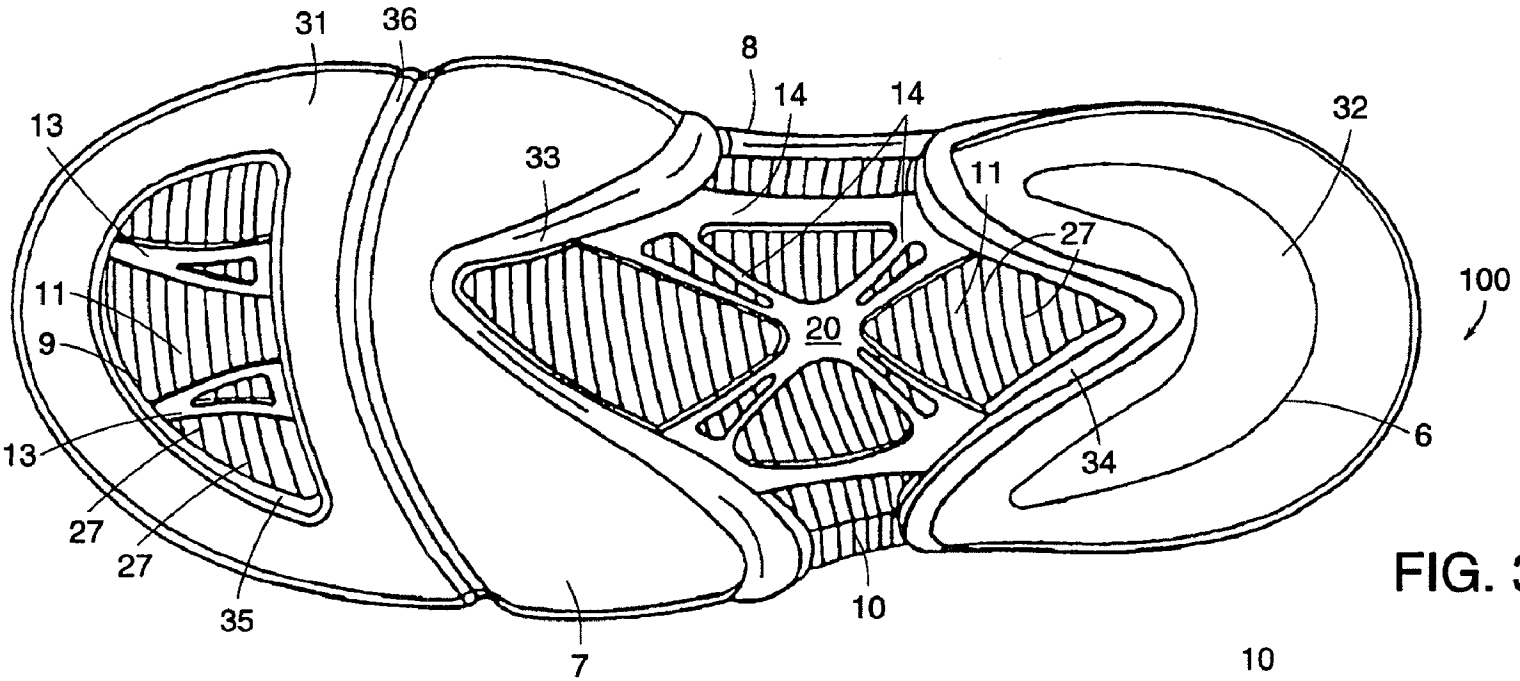
FIG. 3 is a schematic bottom view of one embodiment of an assembled support layer and outsole layer in accordance with the invention.
Figure 4:
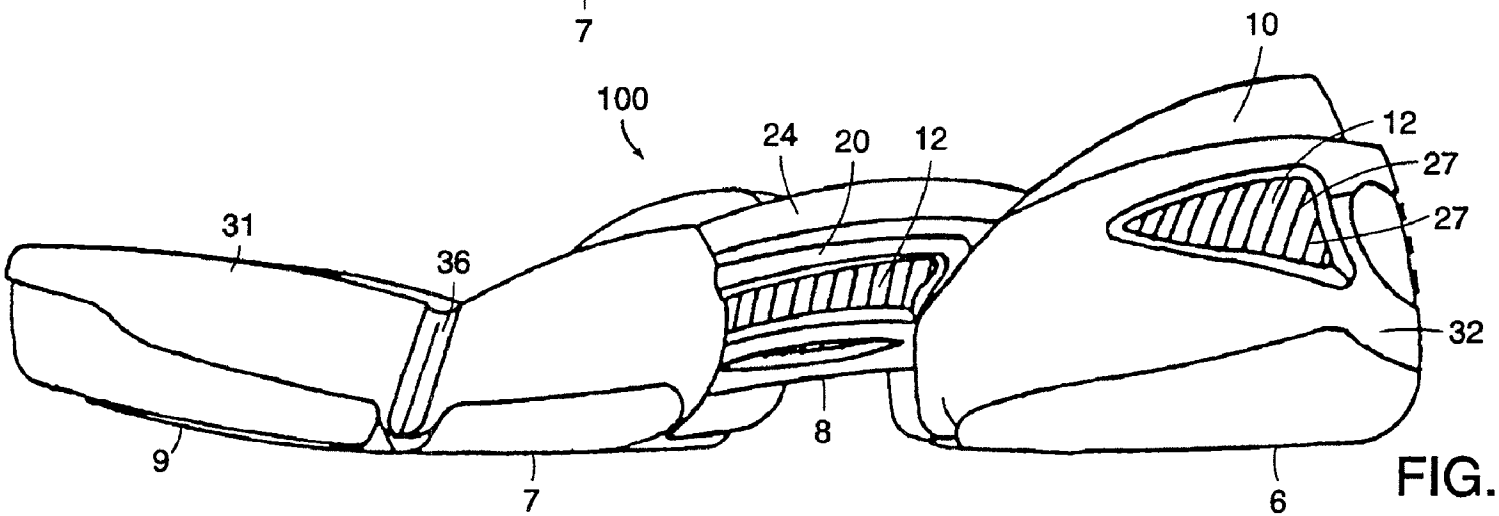
FIG. 4 is a schematic side view of the assembled support layer and outsole layer of FIG. 3.
Figure 5:
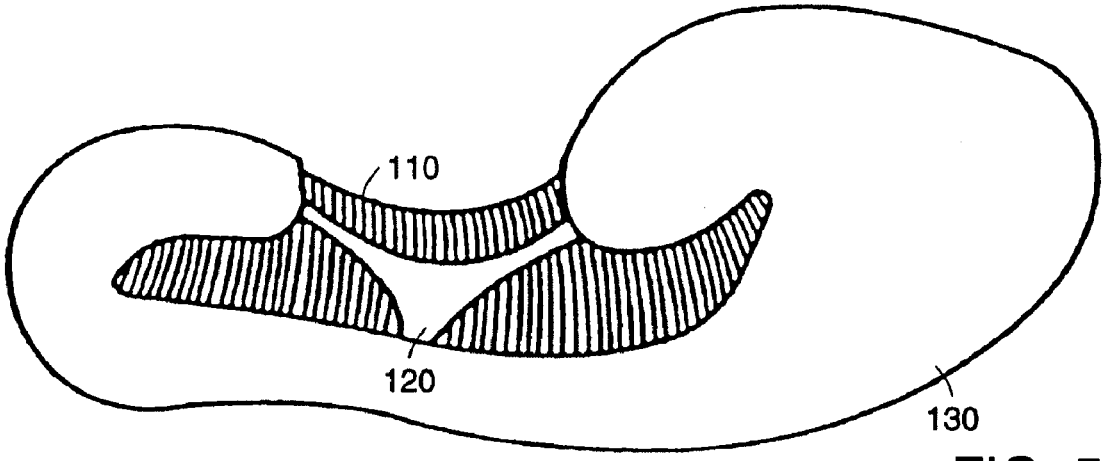
FIG. 5 is a schematic bottom view of another embodiment of an assembled support layer and outsole layer in accordance with the invention.
Figure 6:
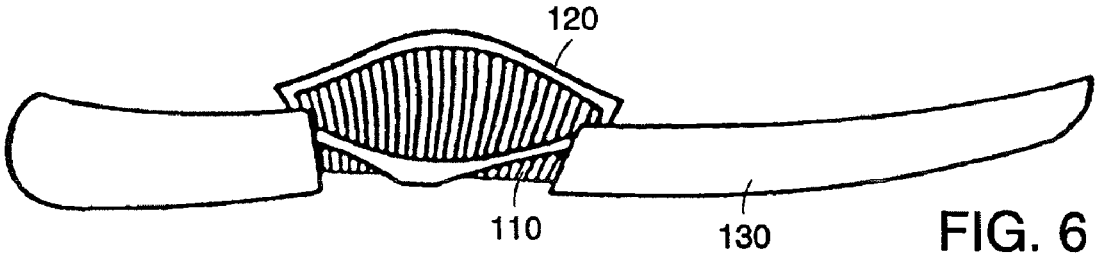
FIG. 6 is a schematic side view of the assembled support layer and outsole layer of FIG. 5.
Figure 7:
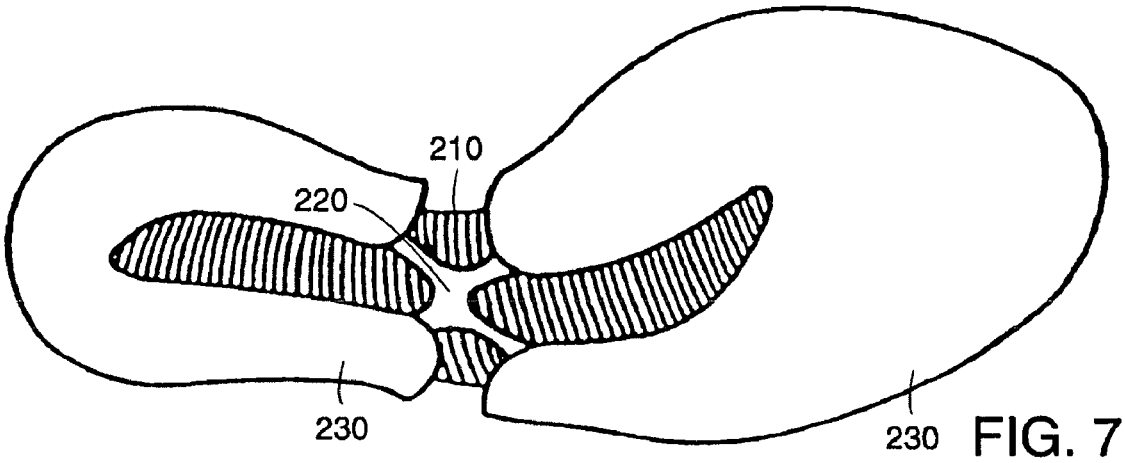
FIG. 7 is a schematic bottom view of yet another embodiment of an assembled support layer and outsole layer in accordance with the invention.
Figure 8:
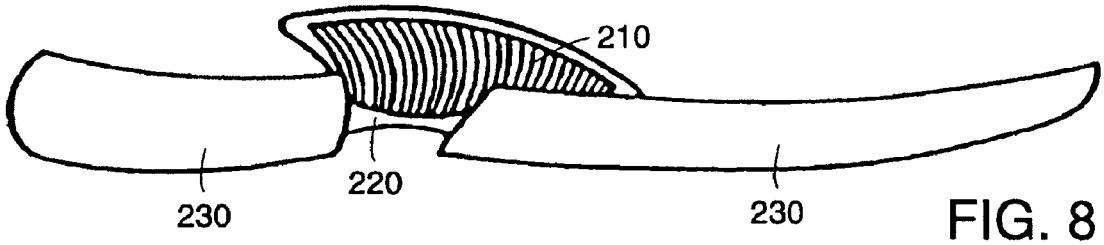
FIG. 8 is a schematic side view of the assembled support layer and outsole layer of FIG. 7.
Figure 11:
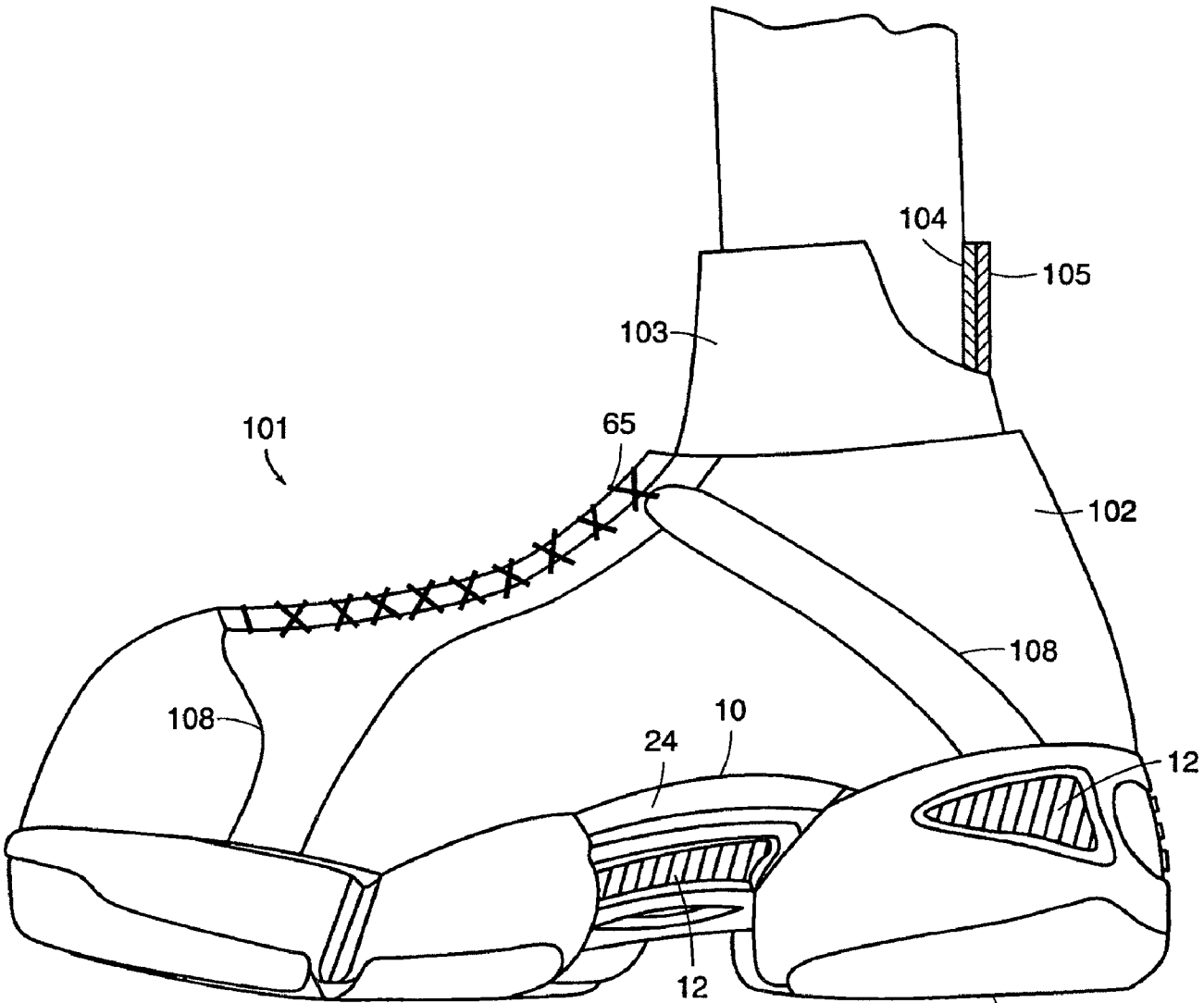
FIG. 11 is a schematic side view of one embodiment of an article of footwear in accordance with the invention.

A sole 100 in accordance with the invention is shown in FIG. 1. The sole 100 includes a support layer 10 arranged below an insole layer 1 and an outsole layer 30 arranged below the support layer 10. The insole layer 1 includes a plurality of openings 2, 3 and can act as a cushioning layer for the sole 100. The support layer 10 may be reinforced from below by a support element 20. Alternatively, the support layer 10 may include a plurality of support elements 20 located at various locations along the sole 100. The outsole layer 30 shown includes a forefoot part 31 and a rearfoot part 32. Alternatively, the outsole layer 30 may include additional sole elements. A tread layer 40 may be provided directly below the outsole layer 30 to improve traction. The tread layer 40 includes a front part 41, which corresponds to the forefoot part 31 of the outsole layer 30 and a rear part 42 that corresponds to the rearfoot part 32 of the outsole layer 30. The outsole layer 30 may also include a cushioning layer 70. FIGS. 3 and 4 depict the sole 100 assembled, as indicated by the dashed arrows in FIG. 1. In addition, an upper 102 of a shoe 101 can be attached to the sole 100, as best seen in FIG. 11.

Figure 2:
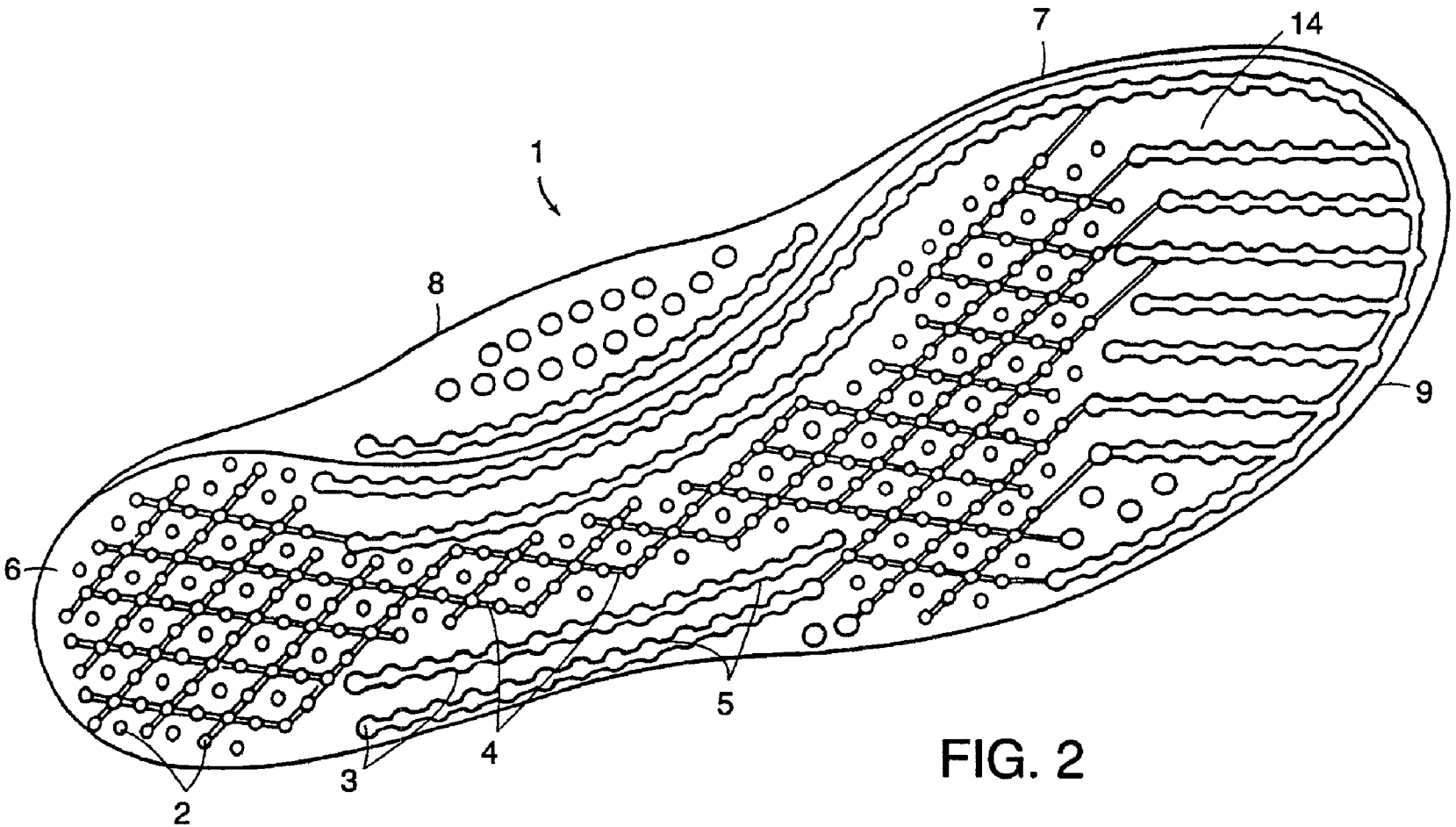
FIG. 2 is a schematic plan view of one embodiment of an insole layer in accordance with the invention, as viewed from below.

The insole layer 1 is depicted in FIG. 2 and includes a plurality of generally circularly shaped openings 2, 3. Alternatively, the openings 2, 3 may have a shape other than circular, for example square, rectangular, elliptical, or any combination thereof. The openings 2, 3 may be distributed over substantially the entire area of the insole layer 1. Generally, the openings 3 have a greater open area than the openings 2 to optimize the permeability of the insole layer 1 for air and humidity transfer. Further, in order to avoid excessive local pressure on the foot sole and at the same time provide adequate ventilation, the openings 2 of the insole layer 1 are preferably smaller in the heel region 6 and/or the ball region 7 of the insole layer 1. In one embodiment, the diameter of the openings 2 in these regions is only about 2 mm to about 3 mm, whereas the diameter of the openings 3 in the remaining regions of the insole layer 1 is about 4 mm to about 5 mm. In other embodiments, the openings 2 located in the heel region 6 and/or the ball region 7 may be substantially smaller than the openings 3 located in other regions of the sole.

The openings 2, 3 are interconnected on a bottom side 14 of the insole layer 1 by at least one channel. In the embodiment shown, a plurality of channels 4, 5 are used. The channels 4, 5 can be arranged on the top side 15 or the bottom side 14 of the insole layer 1 or can even be integrated into the insole layer 1. It has been found, however, that in order to avoid excessive friction between the foot sole and the insole layer 1, and for reasons associated with the manufacture of the insole layer 1, an arrangement on the bottom side 14 is typically beneficial. In one embodiment, most of the larger openings 3 are connected to their respective next opening 3 only by a single channel 5 and the smaller openings 2 are interconnected by a grid-like pattern of crossing channels 4. Not all openings 2, 3 need to be connected to other openings 2, 3.

The insole layer 1 can be manufactured by, for example, injection molding or extrusion. Extrusion processes may be used to provide a uniform shape. Insert molding can then be used to provide the desired geometry of the open spaces, or the open spaces could be created in the desired locations by a subsequent machining operation. The insole layer 1 can be manufactured from any suitable polymeric material or combination of polymeric materials, either with or without reinforcement. Suitable materials include polyurethanes (PU), such as a thermoplastic polyurethane (TPU), ethylene vinyl acetate (EVA), or other comparatively soft material. Other suitable materials will be apparent to those skilled in the art.

By the repeated compression of the insole layer 1 from the mechanical loading of the shoe 101 during ground contact, a pumping action is caused, which quickly transports the humidity surrounding the foot sole down to the support layer 10. For example, in the case of extreme physical activity, such as during a basketball game, hot and humid air develops below the foot sole in the interior of the shoe. In shoe soles 100 according to the present invention, the hot and humid air is transported through the openings 2, 3 down to the support layer 10. The network of channels 4, 5 arranged on the bottom side 14 of the insole layer 1 allow a fast horizontal diffusion of the humidity to the adjacent openings 11, 12 in the support layer 10. This diffusion is facilitated by the repeated compression of the channels 4, 5 on the bottom side 14 of the insole layer 1, which act as small pumps.

Referring to FIGS. 1, 3, and 4, the support layer 10, together with the additional support element 20, forms a frame or chassis around which the shoe 101 is built. The support layer 10, in part, determines the mechanical properties of the shoe in which it is used, such as the response of the shoe to loads arising during a particular sport. The support layer 10 includes a forefoot part 21 having a generally planar shape and a rearfoot part 22 that three-dimensionally encompasses the heel of a wearer's foot, thereby providing support. In one particular embodiment, the support layer 10 extends into the heel region 6 and the ball region 7 of the sole 100 to withstand particularly high mechanical loading on shoes in these areas during repeated ground contact and push-off motions. In addition, a plurality of openings 11 can be arranged in the toe region 9 and/or the arch region 8 of the sole 100 so as not to degrade the support provided by the support layer 10. Additional longitudinal supports 13 can be used to reinforce the stability of the support layer 10 in the toe region 9, and struts 14 can be used to reinforce the support layer 10 in the arch region 8. In addition, lateral flanges 24 can be provided on the support layer 10 with openings 12 to contribute to ventilation of the interior of the shoe 101.

Figure 1B:
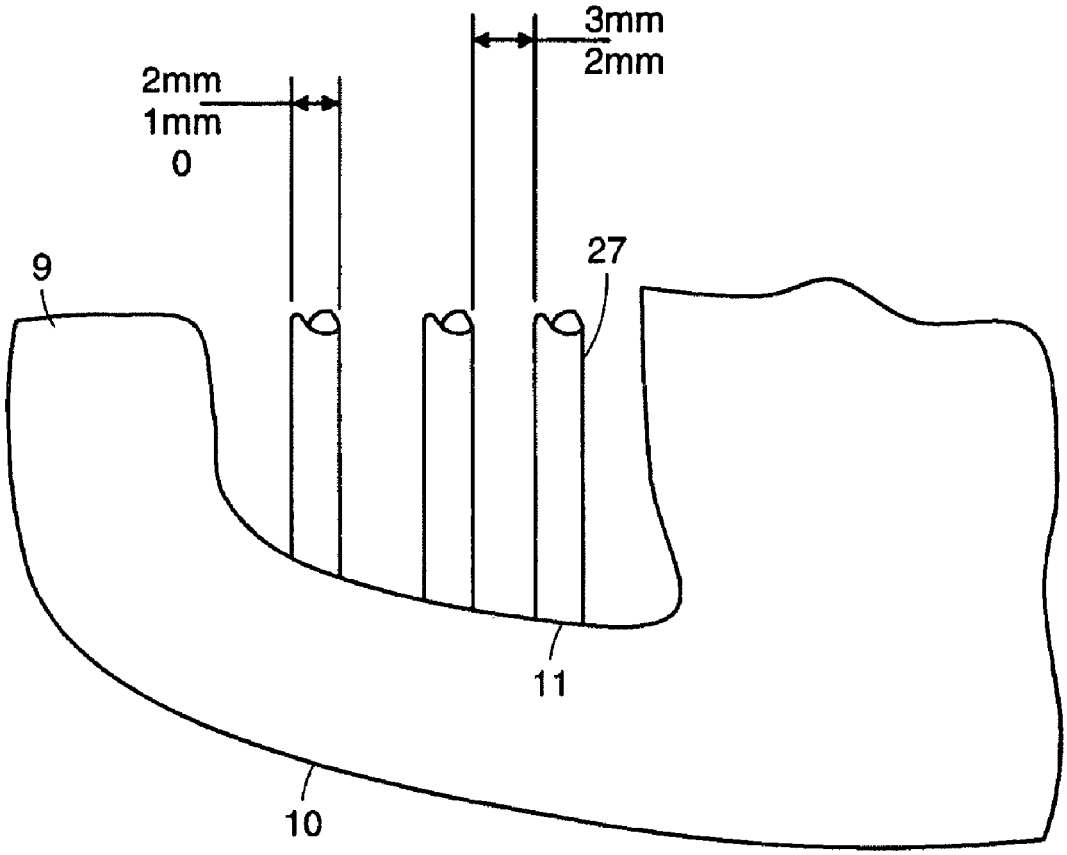
FIG. 1B is an enlarged view of a portion of a support layer depicted in FIG. 1A.

The openings 11, 12 are formed by a series of closely spaced, generally parallel bands or ribs 27 that form a grill or cage pattern and provide a moisture and air pervious structure. As best seen in FIG. 1B, the ribs 27 are generally circularly shaped and have a diameter of about 1 mm to about 2 mm and a spacing of about 2 mm to about 3 mm. The grill pattern is used to achieve a very low resistance to the flow of humidity and hot air while also maintaining the greatest stability of the sole 100. Alternatively, the openings 11, 12 could be circular, rectangular, elliptical, or any combination thereof. The distribution of the openings 11, 12 may affect the mechanical properties of the support layer 10. For example, in one embodiment of the sole 100, no openings are provided in the heel region 6 and the ball region 7 of the sole 100, because these two regions of the sole 100 require a high degree of support in order to avoid excessive pronation or supination of the wearer's foot.

When the insole layer 1 is arranged on top of the support layer 10, the hot and humid air coming down through the openings 2, 3 can pass through the openings 11, 12 in the support layer 10. The majority of the openings 2, 3 in the toe region 9 and the arch region 8 directly overlap with the openings 11, 12 of the support layer 10. The greatest density of the foot's sweat pores are located in the toe region 9 and the arch region 8 of the wearer's foot, therefore, openings in the sole 100 corresponding to those regions furthers the downward guidance of the hot and humid air. The humidity developing in the heel region 6 and the ball region 7 is at first "pumped" through the channels 4, 5 along the bottom side 14 of the insole layer 1, i.e., along the upper side of the support layer 10, until the closest opening 11, 12 in the support layer 10 is reached.

The support layer 10 can be manufactured by, for example, injection molding or extrusion. Extrusion processes may be used to provide a uniform shape, such as a single monolithic frame. Insert molding can then be used to provide the desired geometry of the open spaces, or the open spaces could be created in the desired locations by a subsequent machining operation. Other manufacturing techniques include melting or bonding portions together. For example, the lateral flanges 24 may be adhered to the support layer 10 with a liquid epoxy or a hot melt adhesive, such as (EVA). In addition to adhesive bonding, portions can be solvent bonded, which entails using a solvent to facilitate fusing of the portions.

The support layer 10 can be manufactured out of substantially compression resistant plastic materials, which have the advantage of withstanding the mechanical loads arising during contact of the shoe with the ground and also have the required flexibility not to hinder movements of the foot, such as those that occur during the rolling-off and pushing-off phase of the gait cycle. In particular, the support layer 10 can be manufactured from any suitable polymeric material or combination of polymeric materials, either with or without reinforcement. Suitable materials include: polyurethanes, such as a thermoplastic polyurethane (TPU); EVA; thermoplastic polyether block amides, such as the Pebax® brand sold by Elf Atochem; thermoplastic polyester elastomers, such as the Hytrel® brand sold by DuPont; polyamides, such as nylon 12, which may include 10 to 30 percent or more glass fiber reinforcement; silicones; polyethylenes; and equivalent materials. Reinforcement, if used, may be by inclusion of glass or carbon graphite fibers or para-aramid fibers, such as the Kevlar® brand sold by DuPont, or other similar method. Also, the polymeric materials may be used in combination with other materials, for example rubber. Other suitable materials will be apparent to those skilled in the art. The specific materials used will depend on the particular application for which the shoe is designed, but generally should be sufficiently compression-resistant, supportive, and flexible to the extent necessary for a particular sport.

The support layer 10 can be reinforced by a support element 20 disposed in the arch region 8 of the sole 100. The support element 20 can be an open frame construction with a plurality of openings 23, which may correspond to the openings 11, 12 and the struts 14 of the support layer 10. The support element 20 can affect the resistance of the sole 100 to foot movements, for example torsional movements of the forefoot with respect to the rearfoot. The support element can also control the longitudinal stiffness of the shoe 101. The exact configuration of the support layer 10 and support element 20 can be varied to accommodate numerous applications. For example, different embodiments of the support layer 10 and/or the support element 20 will be used to customize the sole 100 and/or the shoe 101 for a particular activity. In addition, the support element 20 may be secured to the support layer 10 by adhesive bonding, solvent bonding, mechanical retention, or similar techniques. Various alternative embodiments of the support layer 10, 110, 210, the support element 20, 120, 220, and the outsole layer 30, 130, 230 are schematically illustrated in FIGS. 5 to 8.

The support element 20 can be manufactured in any of the manners and materials as described hereinabove for the support layer 10. Although in the embodiment shown in FIG. 1, the support layer 10 and the support element 20 are shown as separate components of the sole 100, an integrated alternative is possible. For example, the support layer 10 and any support elements 20 can be produced as an integral component by dual injection molding.

Referring again to FIGS. 1, 3, and 4, the outsole layer 30 is positioned below the support layer 10 and any additional support elements 20. In the embodiment shown in FIG. 1, the outsole layer 30 includes a forefoot part 31 and a rearfoot part 32. The weight of the shoe 101 is reduced by the absence of any outsole material in the arch region 8 of the sole 100. In addition, large recesses or openings 33, 34, 35 are disposed in the outsole layer 30 to facilitate the dispersion of the hot and humid air from the interior of the shoe 101 via the openings 11, 12 in the support layer 10 to the outside air. Essentially, the openings 33, 34, 35 do not affect the damping properties of the outsole layer 30. The openings 33, 34, 35 are positioned such that they generally correspond with the openings 11, 12 of the supporting layer 10; however, the openings 33, 34, 35 can be positioned to accommodate a particular application.

Because of the thickness of the outsole layer 30, which is in the range of about 0.5 centimeters (cm) to about 2 cm, the openings 11, 12 of the support layer 10 are not in direct contact with the ground. Accordingly, this prevents humidity (water vapor and/or fluid) from easily entering the interior of the shoe 101. If the shoe 101 is not used exclusively for indoor sports, then a breathable membrane 26 can be provided for complete watertightness. The breathable membrane 26 may be positioned between the support layer 10 and the insole layer 1. The breathable membrane 26 may be made out of a breathable, but watertight, material that may further improve the climate properties of the shoe 101, for example the GORE-TEX® brand sold by W.L. Gore & Associates. The sole 100 includes enough openings arranged above and below the membrane 26 that the breathing properties of the membrane 26 are effective without endangering the overall stability of the shoe 101. Furthermore, the grill-like openings 11, 12 of the support layer 10 protect the membrane 26 against damage from below. Further, the membrane 26 prevents stones or dirt from entering the interior of the shoe 1001 and, thereby prevents deterioration of the ventilation properties of the shoe 101 by clogged or closed openings.

In the case of sports with high lateral loading, for example basketball, the outsole layer 30 can extend upwards over the edge of the sole 100, as shown in FIG. 4. Such an arrangement cushions against lateral ground contacts. In addition, the flexibility of the outsole layer 30 can be improved by strategically positioning one or more grooves 36 in the outsole layer 30, for example to facilitate an easier rolling-off phase of the gait cycle. FIGS. 5 to 8 depict alternative embodiments of the outsole layer 30, 130, 230. In the case of a sport such as tennis, which requires a high degree of lateral stability due to strong lateral loading, the embodiment shown in FIG. 5 may be used advantageously.

The traction properties of the sole 100 may be enhanced by the addition of a tread layer 40 below the outsole layer 30. Depending on the particular application, different materials can be used, such as TPU or suitable rubber mixtures that simultaneously provide high abrasion resistance and good traction. The shape of the tread layer 40 typically corresponds to the outsole layer 30 so that the ventilation properties of the sole 101 are not affected by the function specific selection of a suitable tread layer 40. The tread layer 40 can also extend sideways over the edge of the sole 100 to improve grip during lateral ground contact of the foot. Additionally, the outsole layer 30 can include a cushioning layer 70 to enhance the damping properties of the sole 100.

The outsole layer 30, the tread layer 40, and the cushioning layer 70 can be manufactured by any of the methods disclosed herein. In addition, the outsole layer 30, the tread layer 40, and the cushioning layer 70 can be manufactured from any of the materials described herein to suit their particular application. For example, the arrangement and materials used in the outsole layer 30 can affect the damping properties of the shoe 101. As such, foamed materials, such as PU, EVA, and like elastomeric materials, are recommended. These materials are subjected to a strong compression set during the course of their manufacture, such that they permanently keep their elastic damping properties even under high mechanical loading. With respect to the cushioning layer 70, comparatively soft materials, such as PU or EVA, are recommended.

Figure 9:
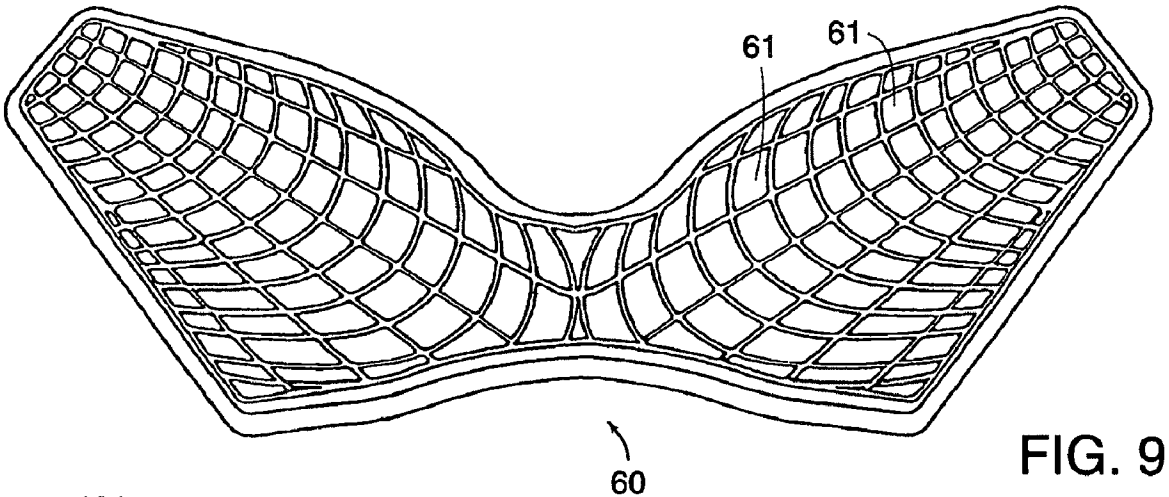
FIG. 9 is a schematic plan view of an embodiment of a net-like protection element in accordance with the invention.
Figure 10:
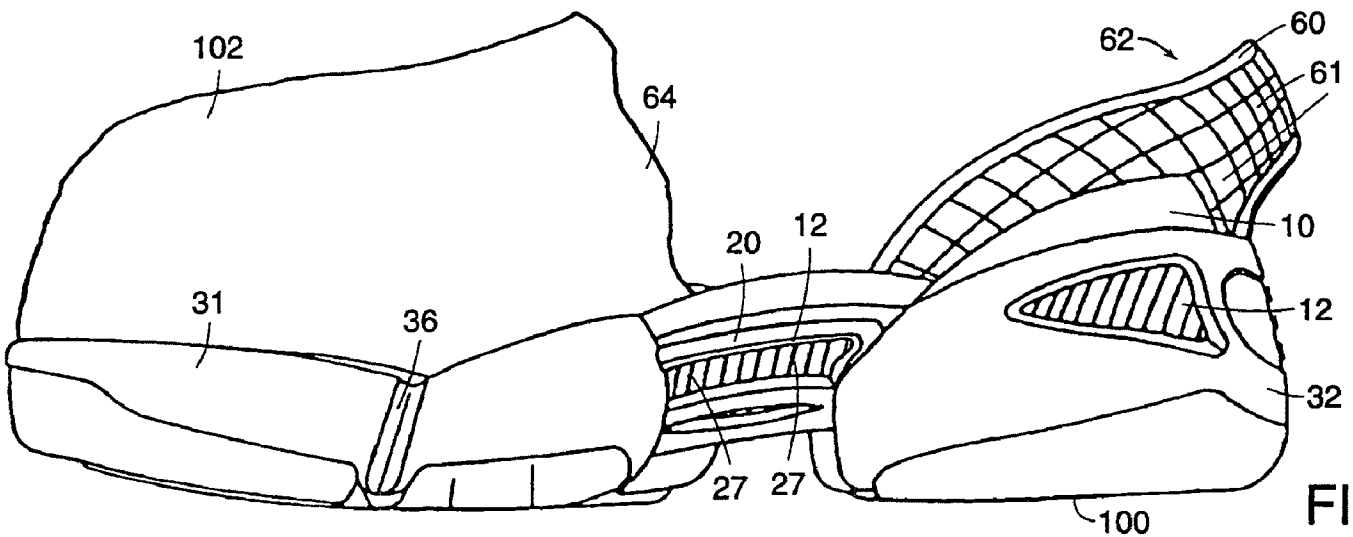
FIG. 10 is a schematic side view of the net-like protection element of FIG. 9 used in accordance with the invention.

Athletic shoes used in sports with many jumps and frequent changes of direction, for example basketball, typically extend upwards over the ankle joint to support the joint and protect against injuries. In one embodiment, the shoe 101 includes a flexible net-like protection element 60, which is shown in FIG. 9 in an unfolded position and in FIG. 10 in its position proximate the ankle area 62 of the shoe 101. In the finished shoe 101, the element 60 is typically covered by a suitable air permeable fabric or mesh.

The protection element 60 is made out of a flexible material, for example EVA or a material based on a silicone elastomer. Alternatively, other soft thermoplastic materials or a PU can be used. The protection element 60 is manufactured in a generally planar configuration and is folded or otherwise manipulated into shape and then secured in place within the shoe 101. Alternatively, the protection element 60 can be directly three-dimensionally shaped, for example by injection molding or other suitable techniques, and then bonded to the shoe 101 and/or sole 100. The protection element 60 includes a plurality of openings 61 that improve the air permeability of this area of the shoe 101. The shape and dimensions of the openings 61 will vary to suit a particular application. The dimensions are in the range of about 2 mm to about 4 mm, up to about 1 cm. The shape of the openings 61 can be circular, rectangular, elliptical, or any combination thereof. In the embodiment shown on FIGS. 9 and 10, the openings 61 have an essentially rectangular shape. The protection element 60 provides good support and protection for the ankle joint, as well as improved ventilation of the interior of the shoe 101, because it replaces commonly used denser materials. Similar protection elements can also be used in other parts of the upper 102, for example in the instep region 64 where excessive pressure may be caused by a lacing system 65 (FIG. 11) of the shoe 101, without reducing the air permeability of the upper 102.

FIG. 11 depicts a shoe 101 and sock 103 assembly according to one aspect of the invention. The shoe 101 includes an upper 102 and a sole 100 in accordance with the invention. The upper 102 can be a reinforced mesh material that includes bands or members 108 that are anchored to the sole 100. The members 108 can provide the structural support for the lacing system 65. The upper 102 can be attached to an edge of the sole's support layer 10 by gluing, stitching, or other suitable techniques. Alternatively, the upper 102 can be any known type or configuration of an upper. The upper 102 shown includes a lacing system 65, which can be any conventional lacing system, such as laces or a hook and loop type fastener, such as the Velcro® brand sold by Velcro Industries B.V. The special sock 103 functions to improve the climate properties of the shoe 101 when used in combination with the sole 100. The sock 103, together with the sole 100, forms an overall system that determines the thermophysiological conditions a foot is subjected to. These conditions are defined by the heat and steam transmission resistances, the steam or water absorption/emission, and the friction forces of the surfaces of the sock and the shoe.

In one embodiment, the sock 103 includes a two layer mesh construction having an inside layer 104 with good diffusion properties and an outsole layer 105 with good absorption properties. The good diffusion properties of the insole layer 104 cause the sweat generated by the foot to be immediately transferred away from the skin to the outer layer 105, for example by capillary wicking. The outside layer's good absorption properties act as a storage for the humidity before it is transported to the ambient air through the openings in the layers of the sole 100. These particular properties of the sock 103 can be achieved by using synthetic fiber materials, such as the Polycolon® brand sold by Schöller, the Dacron® brand sold by DuPont, or the Rhoa®-Sport brand sold by Rhodia.

Figure 12A:
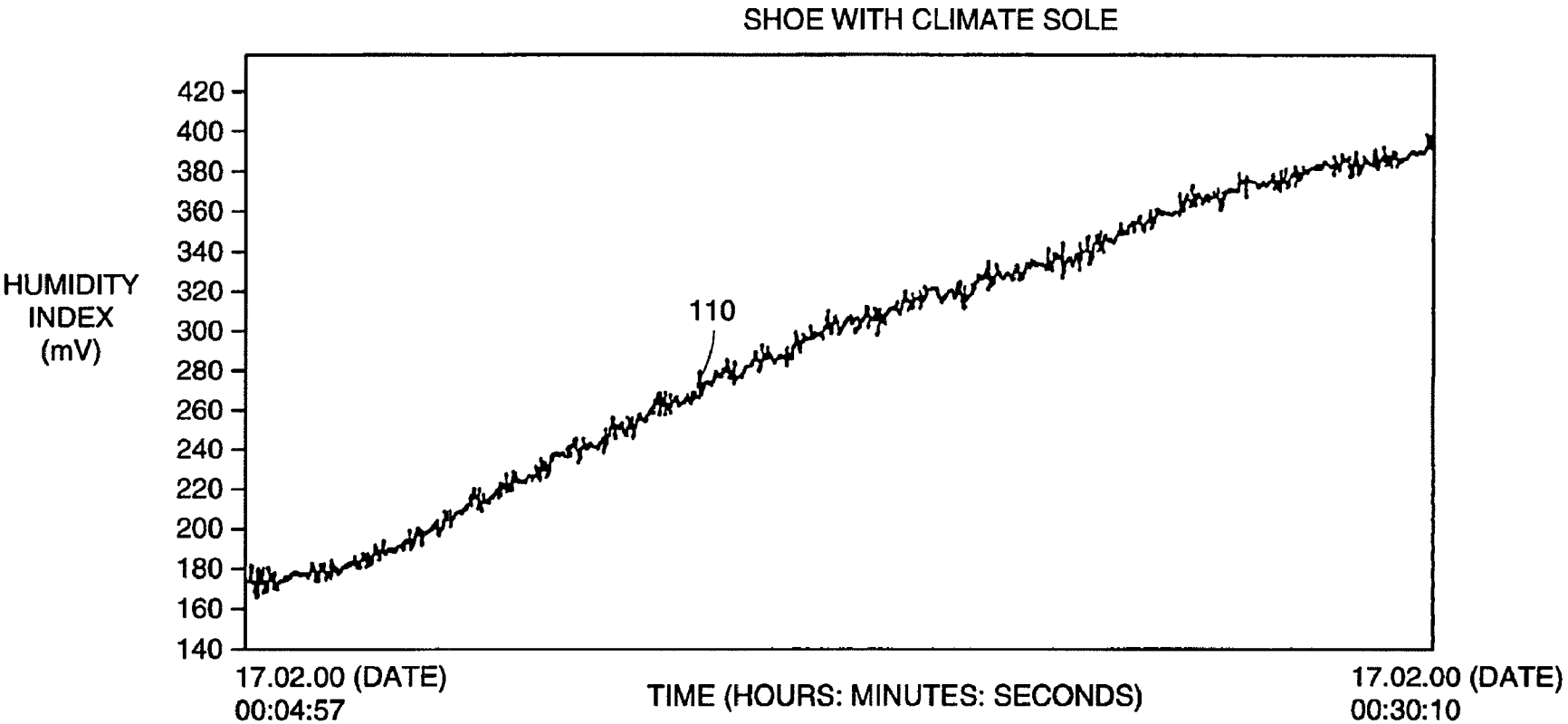
FIG. 12*a* is a graph showing the humidity of a foot climate measuring sock in the interior of a shoe made in accordance with the invention.
Figure 12B:
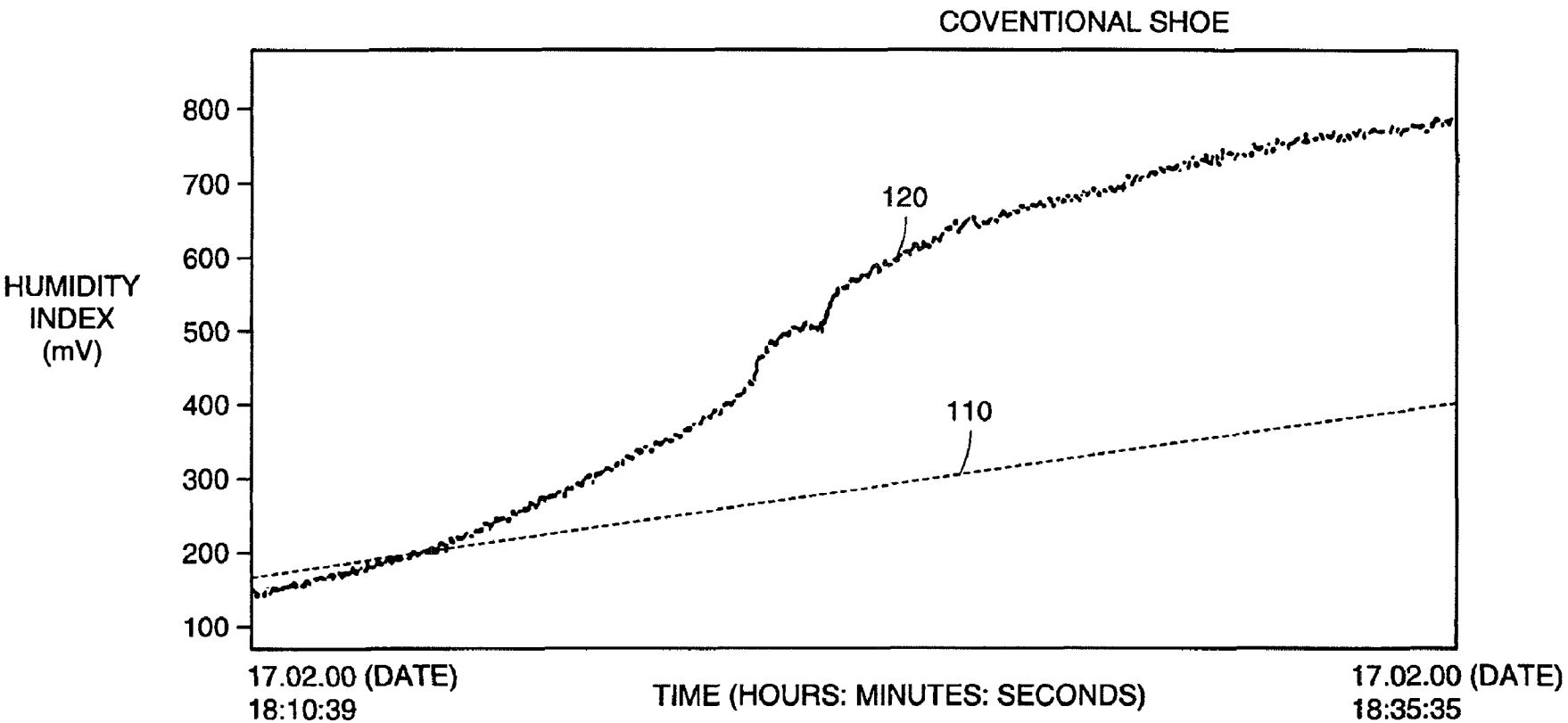
FIG. 12*b* is a graph showing the humidity of a foot climate measuring sock in the interior of a conventional shoe, as compared to the graph of FIG. 12*a*.

A shoe in accordance with the invention was compared to a conventional shoe, the results of which are represented by the graphs shown in FIGS. 12*a* and 12*b*. As can be seen, the shoe in accordance with the invention has substantially improved ventilation properties as compared to the conventional shoe. The testing was performed using a foot climate measuring sock, which made it possible to determine how fast humidity developing in the interior of the shoe is transported to the outside through the sole and the upper. A foot climate measuring sock is a cotton or polyester sock provided with capacitive sensors for measuring humidity and additional sensors for measuring temperature. Since the sensors are very thin, they are not felt by the wearer of the sock. The data measured by the sensors is sent to a personal computer where the humidity and temperature results are analyzed.

FIG. 12*a* shows the measurements taken during an approximately twenty-five minute test on a tread mill with a person wearing a shoe in accordance with the invention. The results are plotted on a graph where the Y-axis represents the Humidity Index as measured in millivolts (mV) and the X-axis represents the length of the test as measured in hours, minutes, and seconds. The increase in humidity in the interior of the shoe is reflected in the increasing voltage plotted along the Y-axis and represented as 110. The graph represents a slow, generally linear increase from approximately 170 mV to approximately 400 mV, i.e., an increase of about 330 mV over a period of about twenty-five minutes.

FIG. 12*b* depicts the results of the same experiment, but performed with a person wearing a conventional sports shoe. Note the scaling of the Y-axis is different in the graph shown in FIG. 12*b* than in FIG. 12*a*. Accordingly, to best illustrate the significant improvement of the inventive shoe, the voltage plot 110 of FIG. 12*b* is manually overlaid on the graph of 12*b*. As can be seen, the voltage 120, which is proportional to the humidity in the interior of the conventional shoe, rises rapidly from approximately 150 mV to approximately 800 mV, i.e., an increase of about 650 mV over a similar twenty-five minute period. Therefore, shoes in accordance with the invention reduce the increase in humidity in the shoe interior by almost 100% with respect to conventional shoes. This result corresponds to reports by test subjects who noticed the improved foot climate properties of the inventive shoes, as compared to the conventional shoes.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. An article of footwear comprising:

an upper at least partially defining an interior void for receiving a foot;

an insole layer comprising a top layer located substantially within the void, the insole layer defining a plurality of first openings;

a support layer located below the insole layer and defining a plurality of second openings that partially overlap the plurality of first openings; and a third layer located below the support layer and at least partially defining at least one third opening extending entirely therethrough, and wherein the third opening at least partially overlaps a portion of the plurality of second openings, wherein the portion comprises at least two openings, such that there exists constant, substantially open fluidic communication between the interior void and the at least one third opening.

2. The article of footwear of claim 1, wherein the third layer comprises a forefoot section and a rearfoot section, wherein the forefoot section and the rearfoot section at least partially define the at least one third opening.

3. The article of footwear of claim 2, wherein the support layer extends between the forefoot section and the rearfoot section, thereby providing support to a foot.

4. The article of footwear of claim 3, wherein the support layer comprises at least one of a lateral flange and a medial flange, wherein at least one of the plurality of second openings extends at least partially through at least one of the lateral flange and the medial flange of the support layer.

5. The article of footwear of claim 3, further comprising a support element disposed between the support layer and the third layer.

6. The article of footwear of claim 5, wherein the support element extends at least partially across the separation between the forefoot section and the rearfoot section.

7. The article of footwear of claim 3, wherein the third opening is located proximate at least one of a lateral side and a medial side of the third layer.

8. The article of footwear of claim 5, wherein the support element at least partially defines at least one fourth opening therethrough, and wherein the at least one fourth opening at least partially overlaps at least two of the plurality of second openings.

9. The article of footwear of claim 1, wherein the support layer comprises a substantially compression resistant semi-rigid chassis.

10. The article of footwear of claim 1, wherein the support layer and the third layer comprise a sole of the article of footwear.

11. The article of footwear of claim 10, wherein the support layer controls deformation properties of the sole.

12. The article of footwear of claim 10, wherein the support layer extends along at least one of a heel region and a ball region of the sole.

13. The article of footwear of claim 10, wherein the plurality of second openings are disposed in at least one of a toe region, an arch region, and an upwardly extending portion of the sole.

14. The article of footwear of claim 11, wherein the plurality of second openings form a grill pattern.

* * * * *